US006009562A

United States Patent [19]

Bullock et al.

[11] Patent Number: 6,009,562

[45] Date of Patent: Jan. 4, 2000

[54] HELMET WITH ACCESSORY MOUNTING APPARATUS AND METHOD OF MAKING THE SAME

[75] Inventors: Christopher Bullock, San Jose; Michael Grim; Flint Thorne, both of Santa Cruz, all of Calif.

[73] Assignee: Bell Sports, Inc., San Jose, Calif.

[21] Appl. No.: 09/140,617

[22] Filed: Aug. 26, 1998

[51] Int. Cl.[7] ..... A42B 3/04

[52] U.S. Cl. ..... 2/422; 2/12; 411/508; 24/297

[58] Field of Search ..... 2/410, 411, 422, 2/424, 10, 12, 6.2, 6.3, 6.4, 425; 24/297; 411/45, 913, 508

[56] References Cited

U.S. PATENT DOCUMENTS

| | | | |
|---|---|---|---|
| 1,347,046 | 7/1920 | McDonough . | |
| 1,522,024 | 1/1925 | Nixon, Jr. . | |
| 2,115,065 | 4/1938 | Dym . | |
| 2,123,275 | 7/1938 | Dym . | |
| 3,082,428 | 3/1963 | Zbikowski . | |
| 3,087,166 | 4/1963 | Howard . | |
| 3,171,133 | 3/1965 | Steffen . | |
| 3,208,080 | 9/1965 | Hirsch . | |
| 3,239,842 | 3/1966 | Marchello | 2/422 |
| 3,310,811 | 3/1967 | Iacono, Jr. . | |
| 3,344,433 | 10/1967 | Stapenhill . | |
| 3,465,363 | 9/1969 | Raney . | |
| 3,496,854 | 2/1970 | Feldmann et al. . | |
| 3,529,306 | 9/1970 | Thorne . | |
| 3,582,990 | 6/1971 | Frieder . | |
| 3,591,863 | 7/1971 | Rickard . | |
| 3,790,962 | 2/1974 | Plastino . | |
| 3,925,821 | 12/1975 | Lewicki . | |
| 3,934,271 | 1/1976 | Rhee . | |
| 3,991,423 | 11/1976 | Jones . | |
| 3,992,722 | 11/1976 | Rhee . | |
| 4,054,953 | 10/1977 | De Barsy . | |
| 4,058,854 | 11/1977 | Rhee . | |
| 4,068,323 | 1/1978 | Gwon . | |
| 4,081,865 | 4/1978 | Bergee et al. . | |

(List continued on next page.)

FOREIGN PATENT DOCUMENTS

| | | |
|---|---|---|
| 2 108 427 | 4/1995 | Canada . |
| 0 042 782 | 12/1981 | European Pat. Off. . |
| 0 096 148 | 6/1982 | European Pat. Off. . |
| 0 394 726 A1 | 10/1990 | European Pat. Off. . |
| 2 241 267 | 4/1975 | France . |
| 2 294 659 | 8/1976 | France . |
| 2 335 168 | 8/1977 | France . |
| 2 340 066 | 10/1977 | France . |
| 29 41 019 | 4/1981 | Germany . |
| 36 32 525 A1 | 3/1988 | Germany . |
| WO 89/01744 | 3/1989 | WIPO . |

*Primary Examiner*—Michael A. Neas
*Attorney, Agent, or Firm*—Limbach & Limbach L.L.P.

[57] ABSTRACT

A helmet and method of making the same for allowing repeatably removable attachment of helmet accessories, that includes an inner liner member for substantially covering a wearer's head, and an outer shell member that includes an upper shell surface, a lower shell surface which substantially covers an upper liner surface of the inner liner member, and at least one mounting hole formed therethrough. A grommet is disposed along the upper shell surface and aligned over the mounting hole. A receptacle housing is disposed along the lower shell surface and has a receptacle aligned to and facing the mounting hole. Engagement prongs secure the grommet to the receptacle housing with the shell member therebetween. The helmet accessory has at least one mounting member, such as a protrusion or screw. The receptacle includes a device for removably engaging the mounting member when the mounting member is inserted through the mounting hole in order to removably mount the helmet accessory to the helmet. An anchor member is connected to the receptacle housing and extends into the inner liner member to engage with a significant volume of the inner liner to secure the receptacle housing in place.

24 Claims, 9 Drawing Sheets

U.S. PATENT DOCUMENTS 4,115,874 9/1978 Hasegawa .
4,141,085 2/1979 Adams, Sr. .
4,300,242 11/1981 Nava et al. .
4,449,275 5/1984 Nava .
4,477,929 10/1984 Mattsson .
4,514,864 5/1985 Huber .
4,519,099 5/1985 Kamiya et al. .
4,534,068 8/1985 Mitchell et al. .
4,538,303 9/1985 Schnitzler .
4,555,816 12/1985 Broersma .
4,599,752 7/1986 Mitchell .
4,612,675 9/1986 Broersma .
4,622,700 11/1986 Sundahl .
4,627,115 12/1986 Broersma .
4,698,856 10/1987 Arai .
4,700,411 10/1987 Kawasaki et al. .
4,744,107 5/1988 Fohl ..... 2/422
4,766,614 8/1988 Cantwell et al. .
4,865,505 9/1989 Okada ..... 411/512
4,878,792 11/1989 Frano ..... 411/339
4,884,301 12/1989 Aileo .
4,995,117 2/1991 Mirage .
5,010,598 4/1991 Flynn et al. .
5,058,212 10/1991 Kamata .
5,083,320 1/1992 Halstead .
5,083,321 1/1992 Davidsson .
5,086,520 2/1992 Arai .
5,093,937 3/1992 Kamata .
5,093,938 3/1992 Kamata .
5,099,523 3/1992 Broersma .
5,119,516 6/1992 Broersma .
5,129,108 7/1992 Copeland et al. .
5,136,728 8/1992 Kamata .
5,170,510 12/1992 Nava .
5,170,511 12/1992 Kamata .
5,212,843 5/1993 Kamata .
5,231,703 8/1993 Garneau .
5,271,102 12/1993 Fenling .
5,333,328 8/1994 Roberts .
5,337,421 8/1994 Jeng .
5,345,614 9/1994 Tanaka .
5,388,277 2/1995 Taniuchi .
5,388,278 2/1995 Taniuchi .
5,448,780 9/1995 Gath .
5,450,631 9/1995 Egger .
5,502,843 4/1996 Strickland .
5,551,094 9/1996 Navone .
5,581,819 12/1996 Garneau .
5,606,784 3/1997 Hamamoto ..... 24/667
5,621,923 4/1997 Tapocik .
5,675,843 10/1997 Grim et al. .
5,680,656 10/1997 Gath .
5,724,681 3/1998 Sykes .

HELMET WITH ACCESSORY MOUNTING APPARATUS AND METHOD OF MAKING THE SAME

FIELD OF THE INVENTION

The present invention relates to helmets, and more particularly to a helmet attachment apparatus for removably attaching accessories to helmets.

BACKGROUND OF THE INVENTION

Lightweight helmets for head protection during bicycle riding falls and accidents have continuously evolved and undergone numerous improvements in recent years. One particular area of refinement has been in the removable attachment of accessories (such as visors, chin guards and ear flaps) to helmets.

U.S. Pat. No. 5,621,923 discloses an interface apparatus that uses screws to attach the visor and chin guard to the helmet. However, modern lightweight bicycle helmets are formed with a thin hard plastic shell surrounding a lightweight foam liner. The foam provides very minimal support for the screws, thus making the screw/shell contacts the primary support for the helmet accessory. The minimal contact between the thin plastic shell and the screw does not provide sufficient support to keep many helmet accessories securely attached to the helmet. For example, a chin guard must attach to the helmet in a manner to withstand a large impact force without becoming detached from the helmet. The screw contact with the thin shell layer of a modern lightweight helmet is simply not strong enough to withstand such impact forces. Further, repeatedly removing and reattaching the accessories with screws can wear out the hole in the thin shell further undermining the ability of the shell to securely engage with the screw.

U.S. Pat. No. 5,675,843 discloses a visor attachment apparatus using a semi-ball protrusion that engages an opening in a mounting plate. U.S. Pat. No. 5,333,328 discloses using hook and loop fastening patches to removably attach a visor to a helmet. While such attachment techniques provide a repeatably removable attachment between helmet and accessory, these type of attachments simply do not provide the requisite strength of attachment necessary for many types of helmet accessories. Chin guard impact forces, the weight of heavy helmet accessories, and/or visor wind resistance at high speeds can be too great for hook/loop or semi-ball/plate fasteners to keep the helmet accessories reliably secured to the helmet during use.

There is a need for a modern, lightweight helmet with an attachment apparatus that removably secures helmet accessories such as visors, chin guards and/or ear flaps to the helmet. Such an attachment apparatus needs to securely attach the helmet accessory to the helmet, yet be repeatable, reliable, inexpensive, and easy to manufacture.

SUMMARY OF THE INVENTION

The present invention solves the aforementioned problems by providing an attachment apparatus in a lightweight helmet for removably attaching a helmet accessory that has at least one mounting member to the helmet. The helmet includes an inner liner member for substantially covering a wearer's head and an outer shell member that includes an upper shell surface, a lower shell surface which substantially covers an upper liner surface of the inner liner member, and at least one mounting hole formed therethrough. A grommet is disposed along the upper shell surface and aligned over the mounting hole. A receptacle housing is disposed along the lower shell surface and has a receptacle that is aligned to and faces the mounting hole. The receptacle includes an engaging means for engaging a helmet accessory mounting member inserted through the mounting hole. Securing means secures the grommet to the receptacle housing with the shell member therebetween.

In another aspect of the present invention, the helmet includes an inner liner member for substantially covering a wearer's head, and an outer shell member that includes an upper shell surface, a lower shell surface which substantially covers an upper liner surface of the inner liner member, and at least one mounting hole formed therethrough. A grommet is disposed along the upper shell surface and aligned over the mounting hole. A receptacle housing is disposed along the lower shell surface and has a receptacle aligned to and facing the mounting hole. Securing means secures the grommet to the receptacle housing with the shell member therebetween. A helmet accessory has at least one mounting member. The receptacle includes means for removably engaging the mounting member when the mounting member is inserted through the mounting hole in order to removably mount the helmet accessory the helmet.

In yet another aspect of the present invention, a method of making a composite helmet, to which a helmet accessory having at least one mounting member can be removably attached, includes the steps of forming an inner liner member for substantially covering a wearer's head; forming an outer shell member that includes an upper shell surface, a lower shell surface for substantially covering an upper liner surface of the inner liner member, and at least one mounting hole formed therethrough; disposing a grommet along the upper shell surface and aligned over the mounting hole; disposing a receptacle housing having a receptacle along the lower shell surface so that the receptacle is aligned to and faces the mounting hole, wherein the receptacle includes means for removably engaging a mounting member of a helmet accessory when the mounting member is inserted through the mounting hole; securing the grommet to the receptacle housing with the shell member therebetween; and affixing the upper liner surface of the inner liner member to the lower shell surface.

Other objects and features of the present invention will become apparent by a review of the specification, claims and appended figures.

DETAILED DESCRIPTION OF THE PREFERRED EMBODIMENTS

Figure 1A:
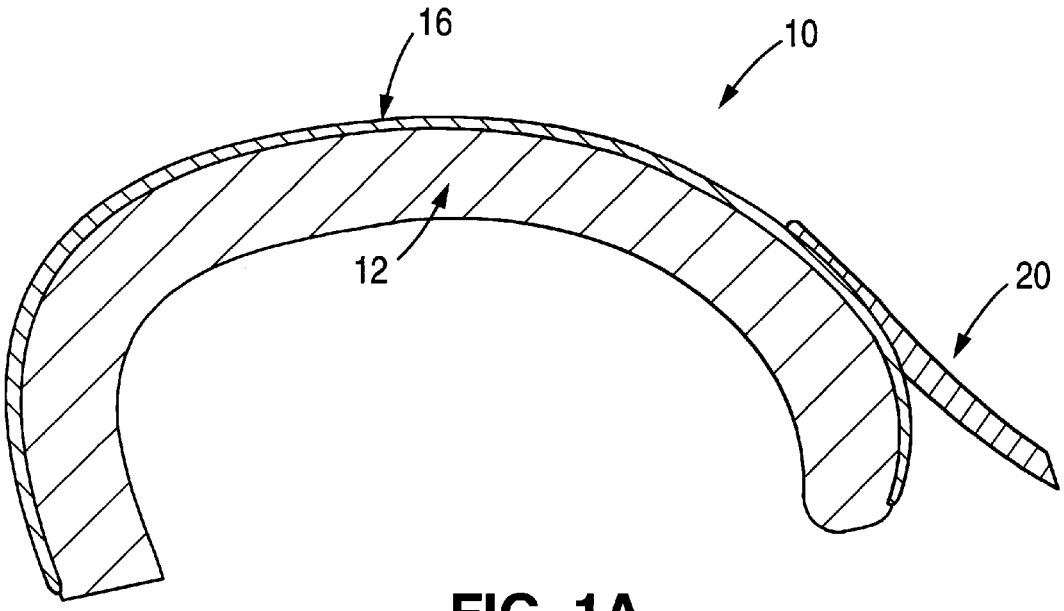
FIG. 1A is a cross-sectional side view of the helmet of the present invention.

While the present invention is applicable to the attachment of various different types of accessories particularly suited for attachment to bicycle and other sports helmets, the preferred embodiment of the invention is an apparatus for securely and removably attaching visors, chin guards and/or ear flaps to lightweight bicycle helmets and will be described with reference thereto as shown in the drawings.

Figure 1B:
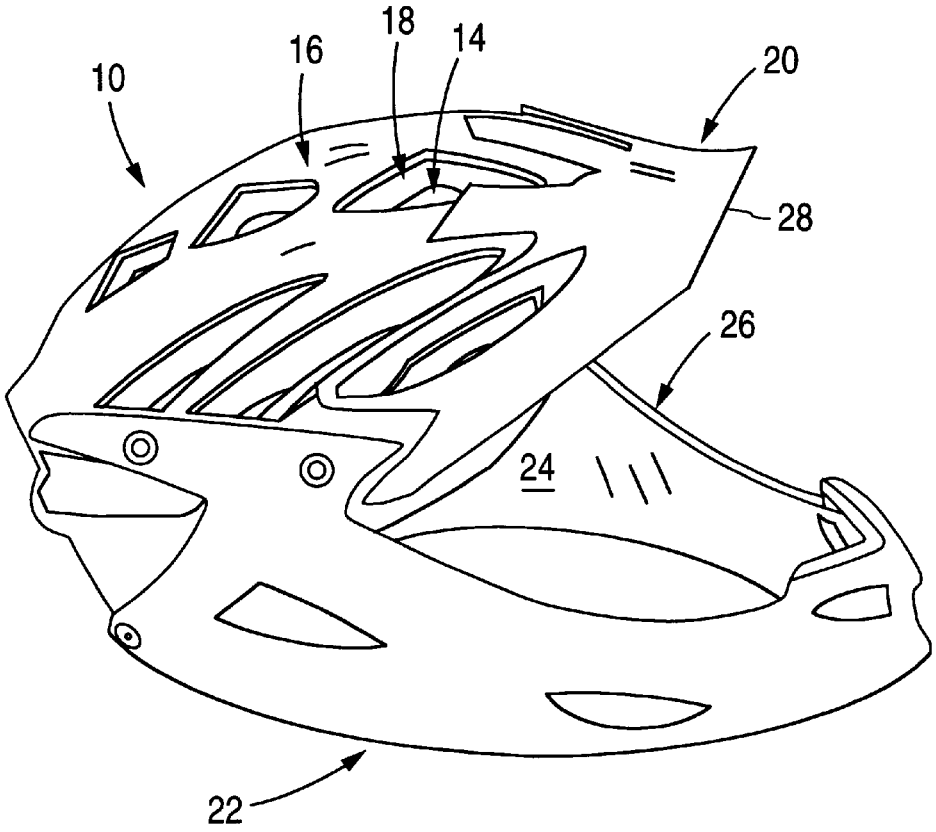
FIG. 1B is a perspective view of the helmet of the present invention.

Referring now to the drawings, with particular reference to FIGS. 1A and 1B, there is shown a bicycle helmet 10 formed of an expanded foam helmet liner 12 having liner vents 14 formed therethrough. A thin, hard plastic helmet shell 16 is attached to, or molded integrally with (insert molded), the top portion of the liner 12. The shell 16 has shell vents 18 corresponding to the liner vents 14. A visor 20, and a chin guard 22 formed of an expanded foam chin guard liner 24 and a hard plastic chin guard shell 26, are removably attached to the helmet 10.

Figure 2A:
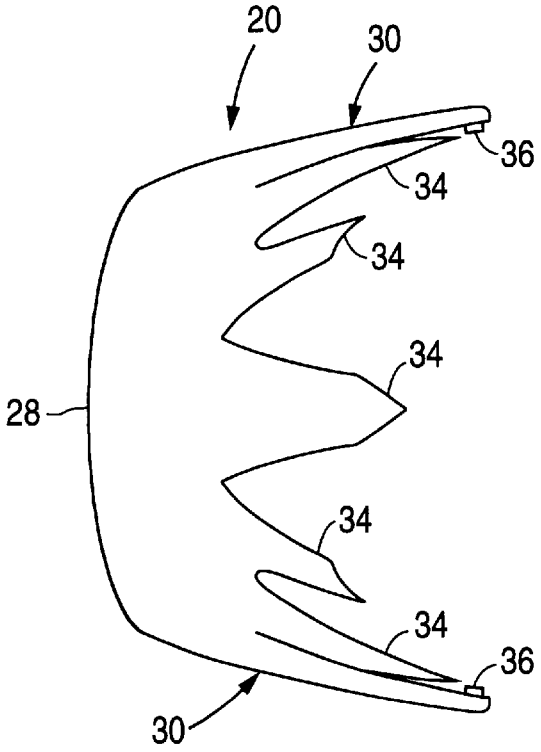
FIG. 2A is a top view of the visor helmet accessory for removable attachment to the helmet of the present invention.
Figure 2B:
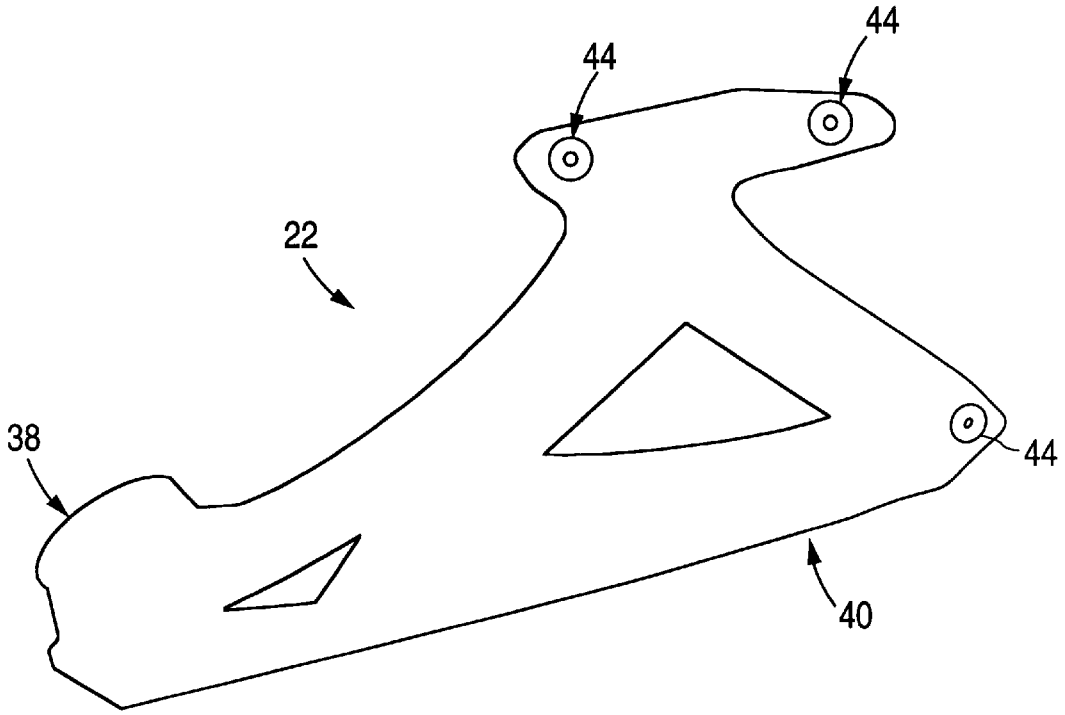
FIG. 2B is a side view of the chin guard helmet accessory for removable attachment to the helmet of the present invention.

Referring now to FIGS. 2A–2B, the visor 20 has a front portion 28 which will project forwardly over the front edge of the helmet to shield the eyes of the wearer. Side portions 30 extend rearwardly from the two sides of the front portion 28, and front upward extensions 34 overlap the shell 16 between the shell and liner vents 18/14, which serves to aerodynamically carry air from the front of the helmet into the helmet vents 18/14. A pair of attachment protrusions 36 are integrally formed at the rearward ends of the side portions 30 to removably attach the visor 20 to the helmet 10.

The chin guard 22 has a front portion 38 which projects forwardly to protect the face of the wearer. Side portions 40 extend rearwardly from the two sides of the front portion 38. Attachment screws 44 are located near the rearward ends of the side portions 40 to removably and securely attach the chin guard 22 to the helmet 10.

Figure 3A:
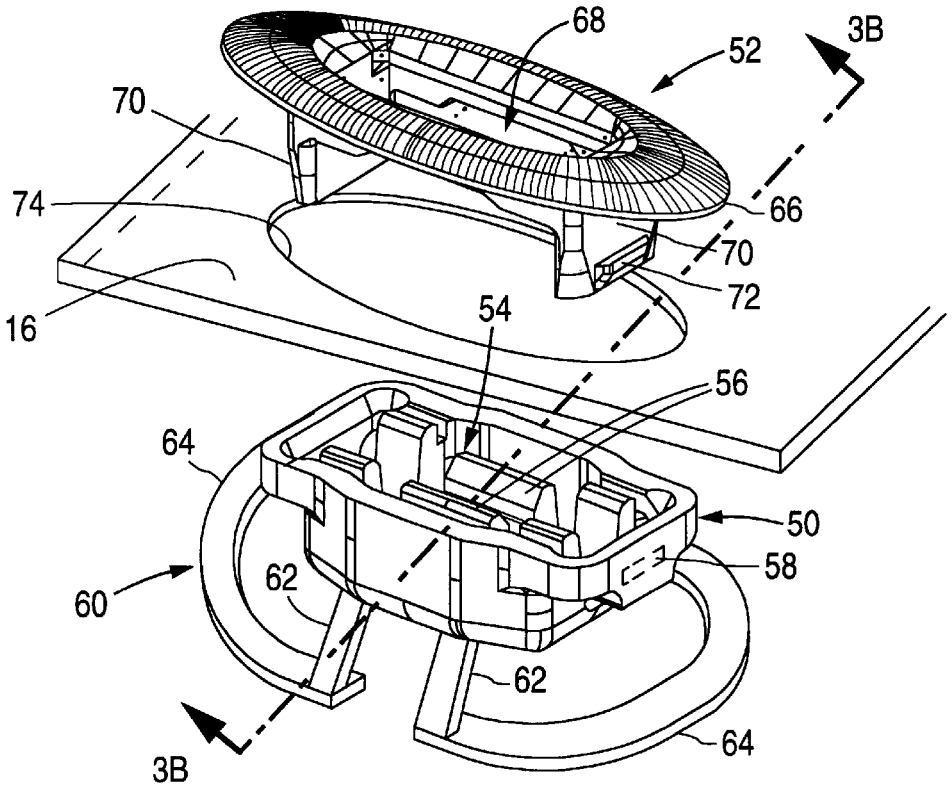
FIG. 3A is an exploded perspective view of the grommet and receptacle housing of the present invention.
Figure 3B:
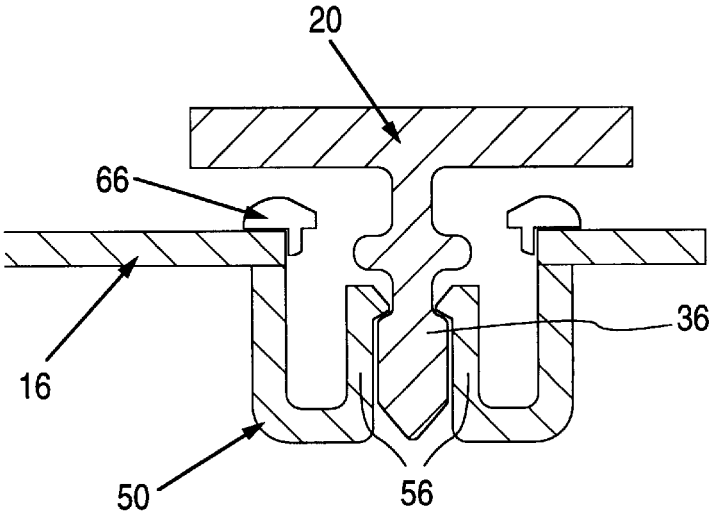
FIG. 3B is a side cross-sectional view of the visor protrusion engaged with the receptacle housing.
Figure 3C:
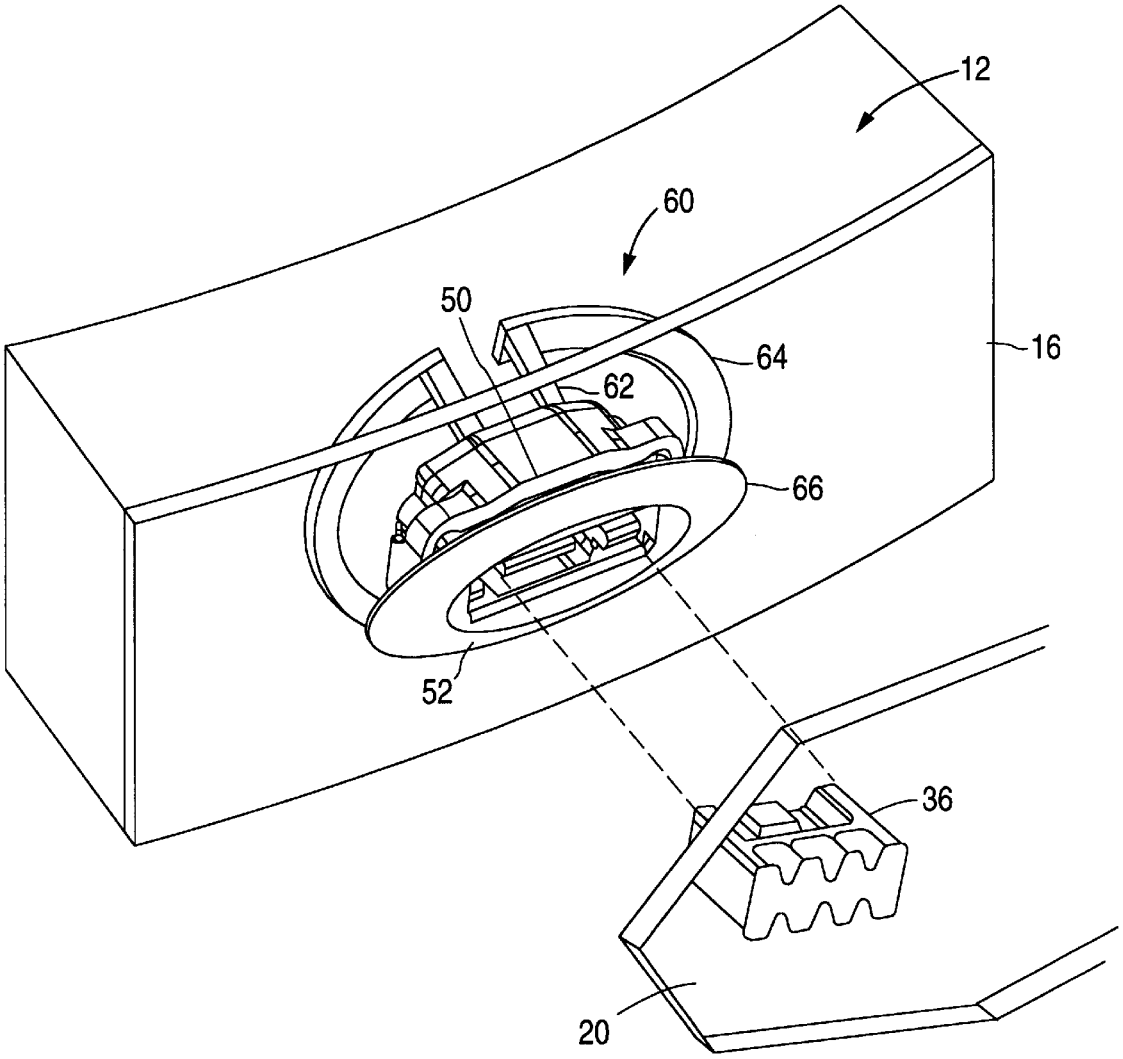
FIG. 3C is an exploded perspective view of the grommet, receptacle housing and visor mounting protrusion of the present invention.

Referring specifically to FIGS. 3A–3C, the attachment apparatus of the present invention, for attaching the visor 20 to the helmet 10, includes a receptacle housing 50 and a grommet 52. The receptacle housing 50 has a receptacle 54 that includes a pair of opposing engagement prongs 56 and opposing engagement shoulders 58. On the opposite side from the receptacle 54, an anchor member 60 with leg members 62 and ring shaped cross members 64 extends from the receptacle housing 50. The grommet 52 includes an elliptically shaped flange 66 with an elliptical shaped center hole 68 formed therethrough, and a pair of engagement arms 70 that extend from flange 66 each terminating with an engagement tab 72.

Elliptical holes 74 are formed in the helmet shell 16 at the locations at which the visor 20 is to attach to the helmet 10. Before the foam liner 12 is attached or formed to helmet shell 16, receptacle housings 50 are secured to the respective grommets 52, with shell 16 therebetween, each by inserting the engagement arms 70 of grommet 52 through shell hole 74 until engagement tabs 72 engage (snap together with) the shoulders 58 of receptacle housing 50. Once receptacle housing 50 and grommet 52 are engaged, flange 66 is secured against the outer surface of shell 16, and receptacle housing 50 is secured against the inner surface of shell 16, with anchor member 60 extending toward the inside of helmet shell 16. The expanded foam liner 12 is then formed preferably by an insert molding process, in which the helmet shell 16 is coated with an adhesive and placed into a mold, and the foam liner 12 is formed by injection molding the foam liner material to the inside surface of shell 16 and around anchor members 60 so that anchor members 60 are fully embedded in the foam liner 12.

To mount the visor 20 to helmet 10, visor protrusions 36 are inserted into the respective receptacles 54 to engage prongs 56 (see FIG. 3B). The visor 20 is removed from helmet 10 by pulling the visor side portions 30 away from helmet 10 with sufficient force to disengage attachment protrusions 36 from engagement prongs 56.

The present invention securely fastens the visor 20 to helmet 10 using both the thin helmet shell 16 and the foam liner 12 formed therein to prevent the receptacle housing 50 from becoming loosened or pulled out from the helmet 10 during prolonged and repeated use. More specifically, engagement housings 50 (to which the visor 20 is attached) are held in place by i) shell 16 via the engagement of grommet 52 and receptacle housing 50 about hole 74, and ii) by liner 12 via the formation of liner 12 about the anchor member 60. The anchor members 60 are especially effective in supporting engagement housings 50 since leg members 62 extend into the foam liner 12 and cross members 64 traverse through the foam liner 12 at different angle(s) than the leg members 62 thus engaging a large volume of the foam liner 12. The rotation of the receptacle housing 50 and the visor 20 is prevented by using elongated holes 74 engaged by elongated grommets 52 and receptacle housings 50, and elongated receptacles 54 and engagement prongs 56 engaged by elongated attachment protrusions 36. Thus, the visor of the present invention attaches to the helmet 10 at only two places (one on each side of the helmet), whereas prior art visors are typically attached to the helmet in 3 or more places (including in the front portion of the helmet) in order to keep the visor properly secured to the helmet 10 during use.

Figure 4A:
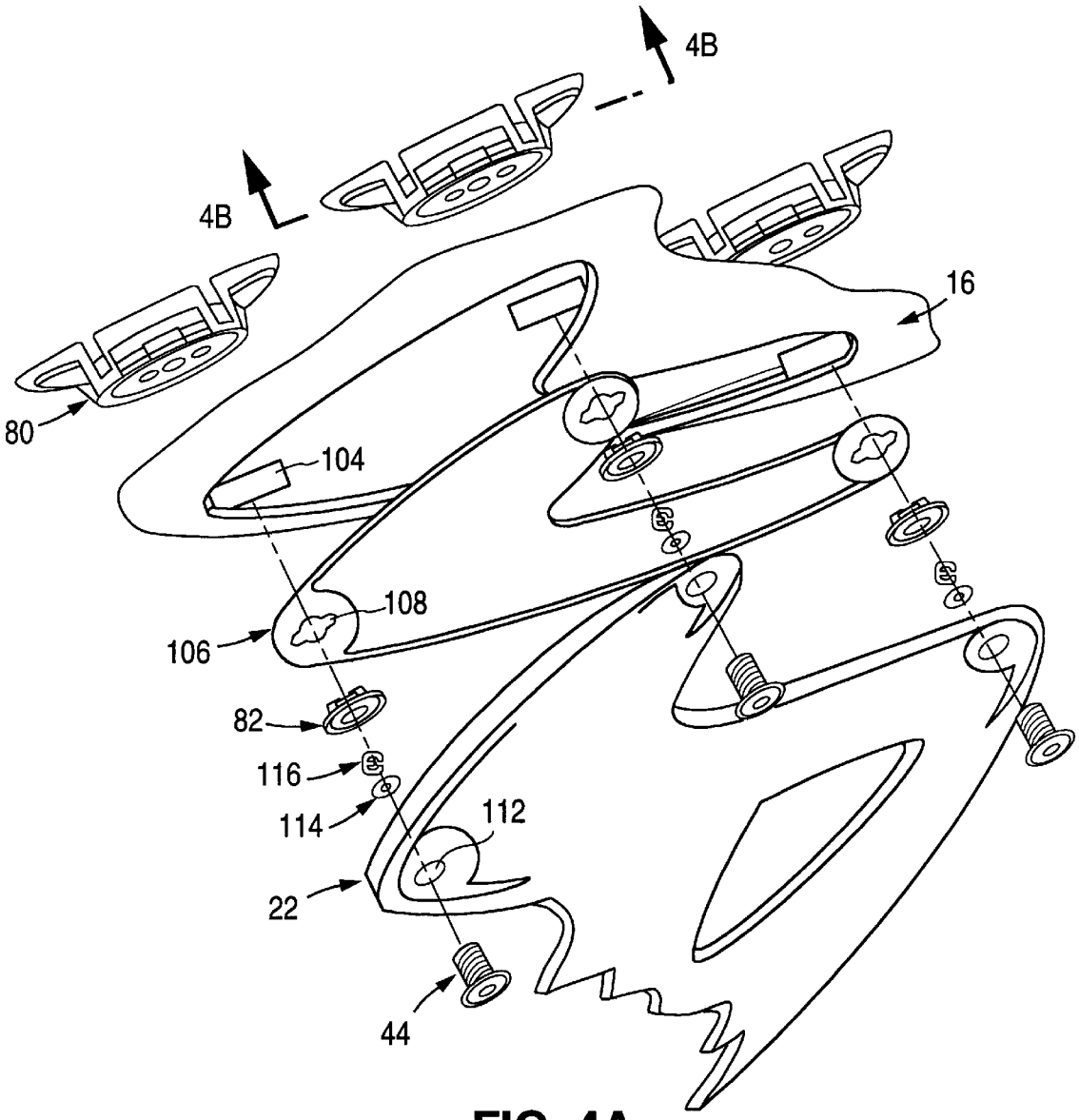
FIG. 4A is an exploded perspective view of an alternate embodiment of the present invention for removably mounting a chin guard to the helmet.
Figure 4B:
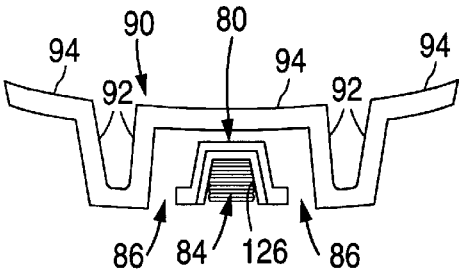
FIG. 4B is a side cross-sectional view of the receptacle housing and anchor of the alternate embodiment.
Figure 4C:
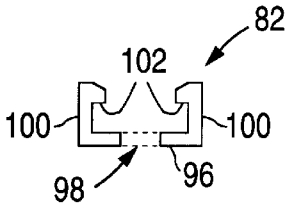
FIG. 4C is a side cross-sectional view of the grommet of the alternate embodiment.

FIGS. 4A–4C illustrate an alternate embodiment of the present invention, which includes a receptacle housing 80 and grommet 82 to removably secure the chin guard 22 to helmet 10. The receptacle housing 80 has a threaded receptacle 84 and engagement holes 86 on either side thereof. On the opposite side from the receptacle 84, an anchor member 90 is formed with leg members 92 connected to receptacle housing 80 and cross members 94 extending therebetween. The grommet 82 includes an annular flange 96 with a center hole 98 and a pair of engagement arms 100 each terminating with an engagement tab 102.

Holes 104 are formed in the helmet shell 16 at the locations at which the chin guard 22 is to attach to the helmet 10. Before the foam liner 12 is formed, receptacle housings 80 are secured to the respective grommets 82, with shell 16 (and in the preferred embodiment a boomerang shaped spacer 106 with holes 108 to properly locate and orient the grommets 82) therebetween, each by inserting the engagement arms 90 of grommet 82 through shell hole 104 (and spacer hole 108) until engagement tabs 92 engage (snaps together with) the inner rim of engagement holes 86 in receptacle housing 80. Once receptacle housing 80 and grommet 82 are engaged together, flange 96 is secured against the outer surface of shell 16 (and boomerang spacer 106), and receptacle housing 80 is secured against the inner surface of shell 16, with anchor member 90 extending toward the inside of helmet shell 16. Foam liner 12 is insert molded to helmet shell 16 as previously described to adhere the foam liner 12 to the shell 16 and to integrally form the foam liner 12 to integrally surround the anchor members 90.

To mount the chin guard 22 to helmet 10, screws 44, which are mounted through holes 112 of chin guard 22 and preferably held thereon by washer 114 and E-clip 116, are inserted through helmet holes 104 (and spacer holes 108) and threaded into the respective receptacles 84 until fully tightened. The chin guard is securely mounted to the helmet 10 via the engagement of receptacle housing 80 and grommet 82 to shell 16, together with the engagement of anchor member 90 to a large volume of foam liner 12. Shell holes 104 (and/or spacer holes 108) are notched or elliptical in shape to prevent rotation of the receptacle housing 80 during mounting and removal of chin guard 22 to/from helmet 10.

Figure 5A:
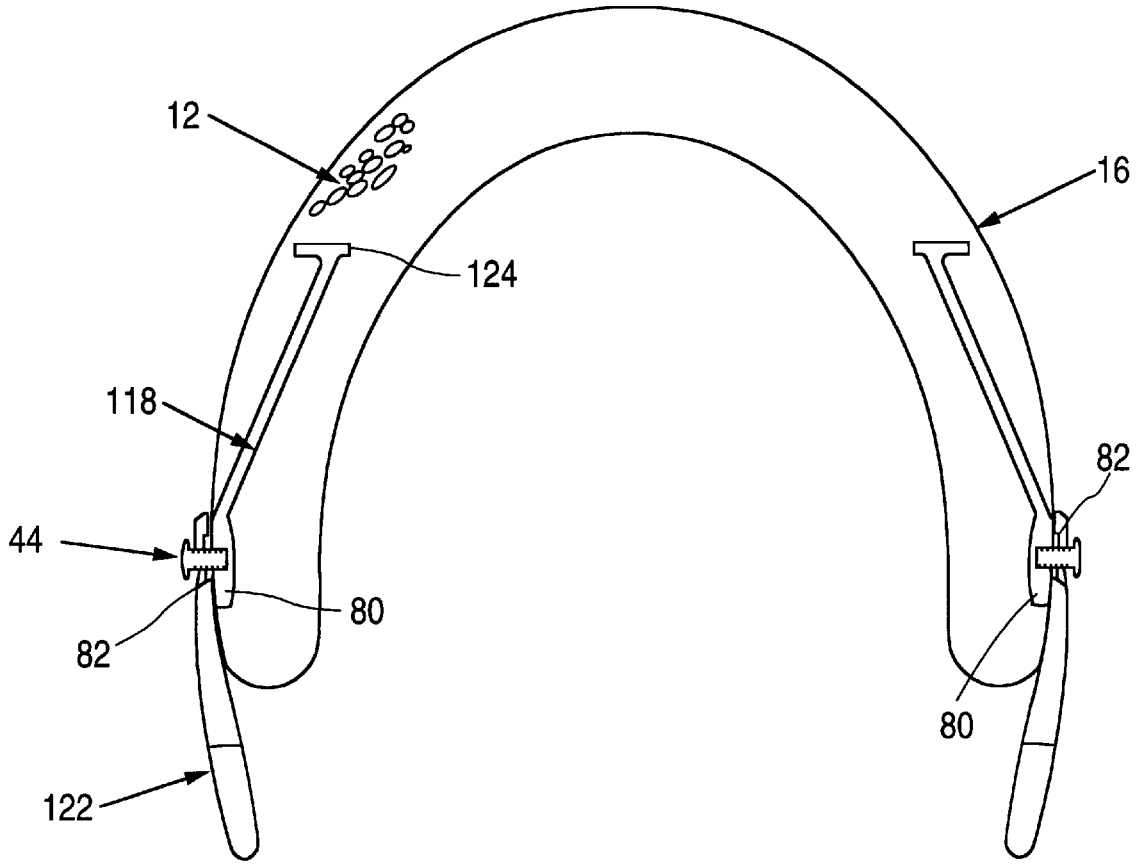
FIG. 5A is a front cross-sectional view of a second alternate embodiment of the present invention.
Figure 5B:
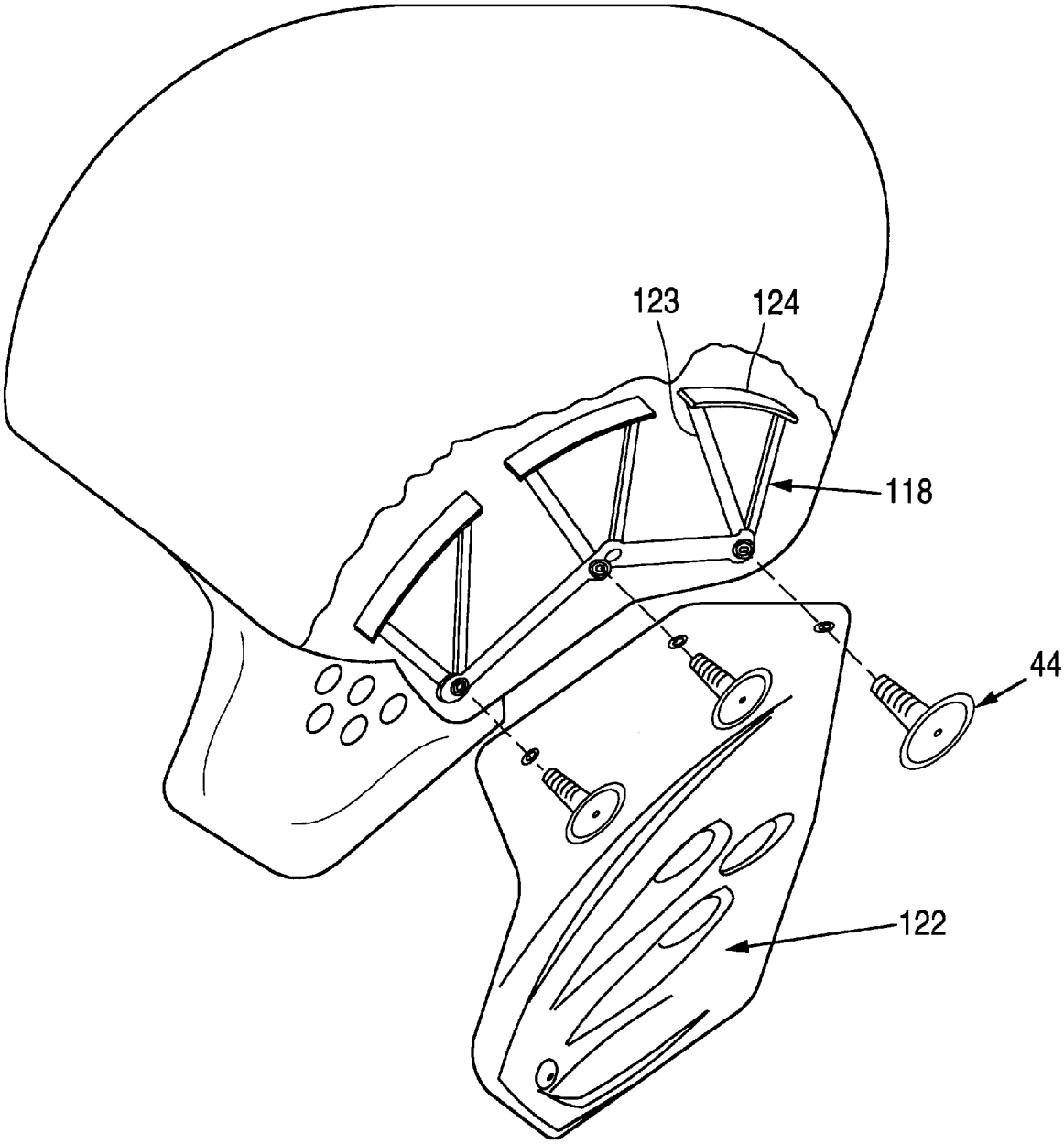
FIG. 5B is a partially broken away side perspective view of the second alternate embodiment of the present invention.

FIGS. 5A and 5B illustrate a second alternate embodiment of the present invention, which is similar to the first alternate embodiment of FIGS. 4A–4C, except a specially shaped anchor 118 integrally formed with the receptacle housing 80 is used to mount earflaps 122 to the helmet 10 for keeping the ears of the wearer warm. In this embodiment, anchors 118 have leg members 123 extending mostly vertically through the side portions of foam liner 12, and terminate with cross members 124. Anchors 118 provide exceptional support for the mostly downward force applied thereto by ear flaps 122 during use. This embodiment illustrates that the designed shape of the anchors of the present invention can be selected to provide the desired support inside the foam liner for particular forces induced from a given helmet accessory attached to the helmet 10.

Helmets according to the above described embodiments have been developed, where shell 16 is preferably made of plastic, foam liner 12 is preferably made of any expanded foam material, such as expanded polystyrene or expanded polypropylene, and insert molded to shell 16. The chin guard shell is preferably made of glass reinforced nylon. The visor 20, receptacle housings 50/80, grommets 52/82, anchor members 60/90/118, and boomerang spacers 106 are all preferably made of nylon. Screws 44 are made of metal, and preferably engage a threaded metal liner 126 embedded in the receptacle 84 for added strength.

Figure 6:
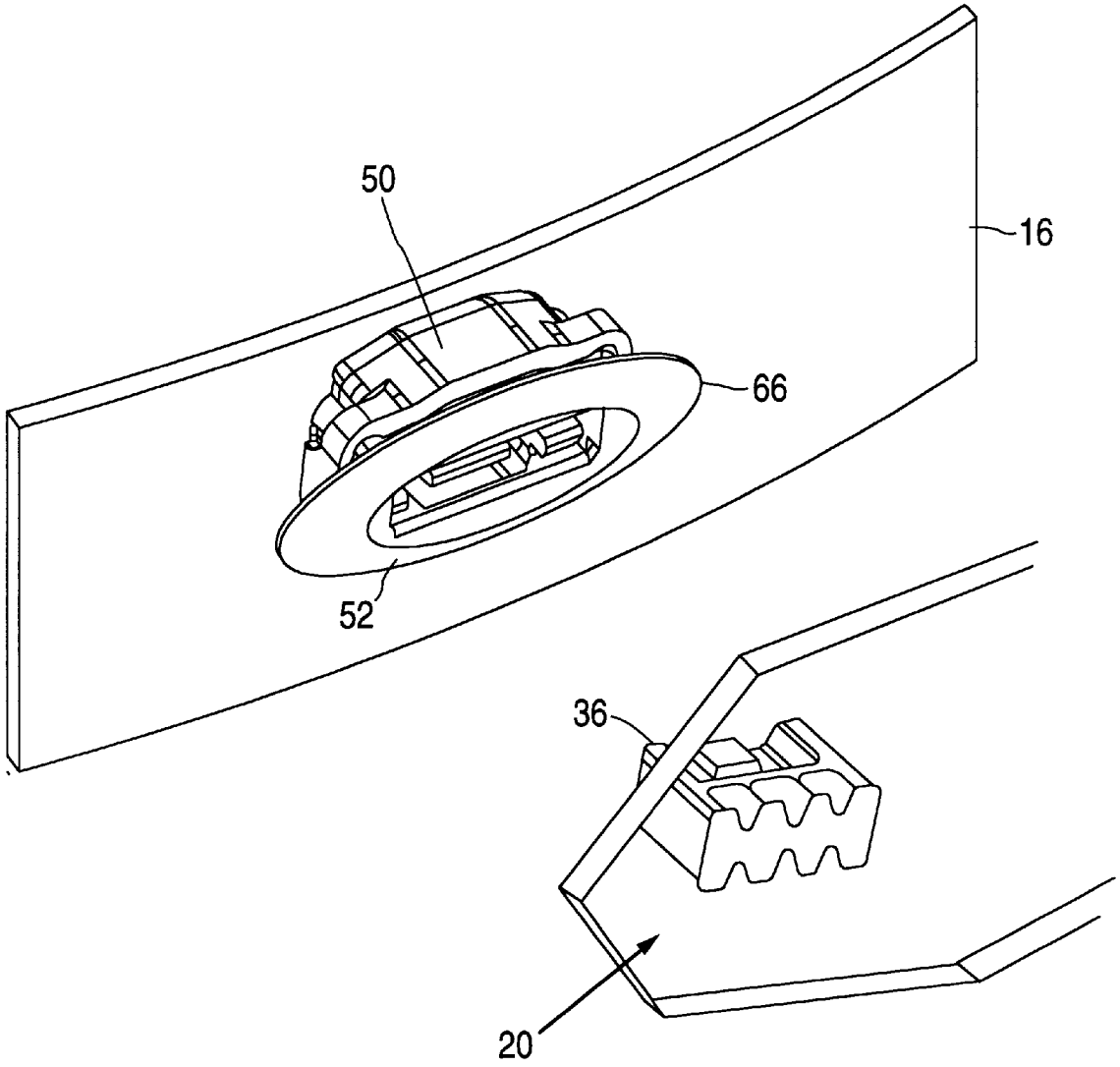
FIG. 6 is an exploded perspective view of a third alternate embodiment of the present invention.

For some accessories such as extremely light visors, or for helmets having exceptionally thick shells 16, it may be deemed unnecessary to utilize anchors embedded in the foam liner 12 to properly secure a particular accessory to the helmet 10. It is within the scope of the present invention to use receptacle housings engaged with grommets through a hole in the helmet shell as described above, without including anchor members connected to the receptacle housings, for attaching accessories to a helmet, such as the embodiment illustrated in FIG. 6. Where anchors are not used, the foam liner 12 can either be insert molded onto shell 16, or formed separately and simply adhered to shell 16 using tape or adhesive, before or after the receptacle housings and grommets have been attached to the shell 16, since no anchors need be integrally molded into the foam liner.

It is to be understood that the present invention is not limited to the embodiments described above and illustrated herein, but encompasses any and all variations falling within the scope of the appended claims. For example, the receptacle housings and grommets of the present invention can be used to attach any type accessory to the helmet, not just visors, chin guards and ear flaps. Further, it is not necessary to attach the grommets to the receptacle housings before the liner is insert molded to the shell. Instead, the receptacle housings can be adhered to the inside of the helmet shell using tape or an adhesive before the foam liner is insert molded to the shell. The tape or adhesive need only keep the receptacle housings in place during the insert molding of the foam liner. Once the insert molded shell and liner are removed from the mold, the grommet is then attached through the hole in the shell thus more securely fixing the receptacle housings to the shell. Alternately, the foam liner can be formed with the receptacle housings embedded therein, after which the liner is attached to the shell and the grommet is engaged with the receptacle housing.

Figure 7A:
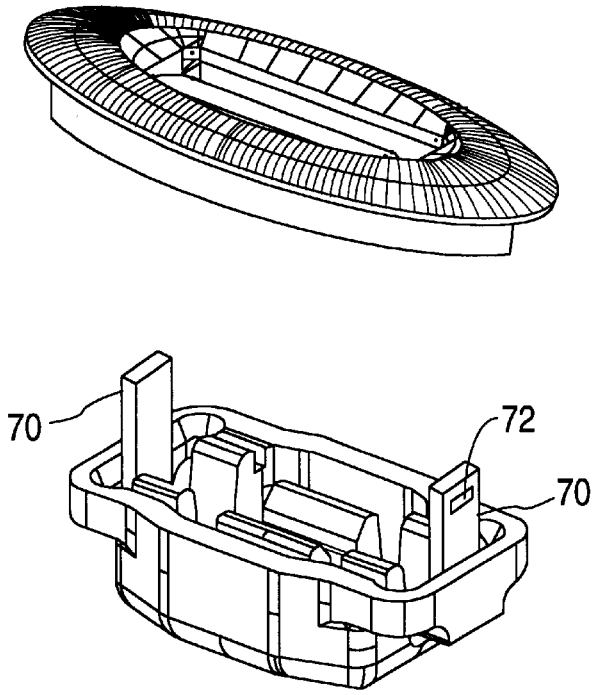
FIGS. 7A–7B are exploded perspective views of alternate embodiments for securing the receptacle housings to the grommets of the present invention.
Figure 7B:
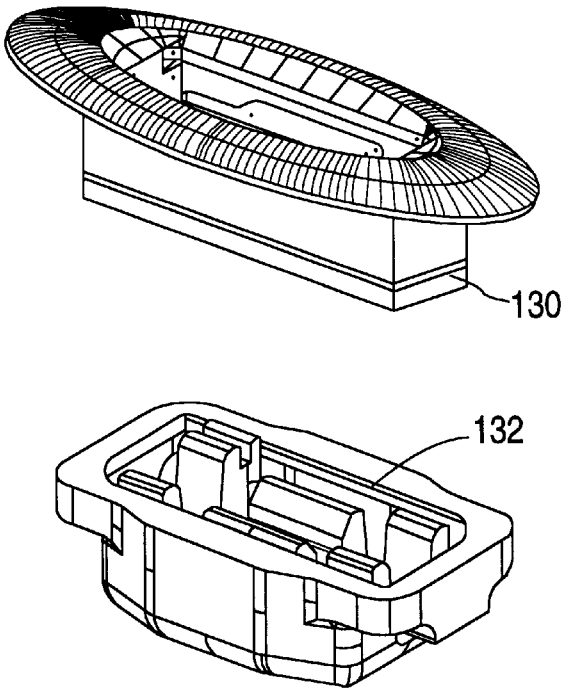

The receptacle housings of the present invention illustrated above are secured to the grommets using engagement arms extending from the grommet to engage with the receptacle housing. However, there are other ways in which these elements can engage each other, such as engagement arms 70 extending from the receptacle housing to engage with the grommet (as illustrated in FIG. 7A), or an annular engagement rim 130 in one of the grommet and the receptacle housing to engage an annular shoulder in the other (FIG. 7B), or any other equivalent member of grommet or receptacle housing engaging the other to semi-permanently or permanently secure these two elements together.

What is claimed is:

1. A helmet with attachment apparatus for attaching a helmet accessory having at least one mounting member to the helmet, comprising:

an inner liner member for substantially covering a wearer's head;

an outer shell member that includes:

an upper shell surface, a lower shell surface which substantially covers an upper liner surface of the inner liner member, and at least one mounting hole formed therethrough;

a grommet disposed along the upper shell surface and aligned over the mounting hole;

a receptacle housing disposed along the lower shell surface and having a receptacle that is aligned to and facing the mounting hole and that includes means for engaging a helmet accessory mounting member inserted through the mounting hole;

means for securing the grommet to the receptacle housing with the shell member therebetween.

2. The helmet of claim 1, further comprising:

an anchor member that is connected to the receptacle housing and which extends into the inner liner member.

3. The helmet of claim 2, wherein the anchor member includes:

at least one leg member portion extending in one direction away from the receptacle housing and into the inner liner member, and a least one cross member portion which traverses through the inner liner member in a different direction than the one direction to prevent the anchor member from becoming detached from the inner liner member.

4. The helmet of claim 1, wherein the inner liner member is insert molded to the outer shell.

5. The helmet of claim 1, wherein the engagement means includes a pair of opposing prongs for engaging a helmet accessory mounting member.

6. The helmet of claim 1, wherein the engagement means includes a threaded recess for engaging a threaded helmet accessory mounting member.

7. The helmet of claim 1, wherein the mounting hole has a non-circular shape.

8. The helmet of claim 1, wherein the receptacle has a non-circular shape.

9. The helmet of claim 1, wherein the securing means includes:

engagement arms extending from one of the grommet and the receptacle housing for engaging a tab formed on the other of the grommet and the receptacle housing.

10. The helmet of claim 1, further comprising:

a shaped spacer disposed between the upper shell surface and the grommet and having a spacer hole aligned over the mounting hole, wherein the grommet is aligned to the spacer hole for properly locating and orienting the grommet on the upper shell surface.

11. A helmet comprising:

an inner liner member for substantially covering a wearer's head;

an outer shell member that includes:

an upper shell surface, a lower shell surface which substantially covers an upper liner surface of the inner liner member, and at least one mounting hole formed therethrough;

a grommet disposed along the upper shell surface and aligned over the mounting hole;

a receptacle housing disposed along the lower shell surface and having a receptacle aligned to and facing the mounting hole;

means for securing the grommet to the receptacle housing with the shell member therebetween; and a helmet accessory having at least one mounting member;

wherein the receptacle includes means for removably engaging the mounting member when the mounting member is inserted through the mounting hole to removably mount the helmet accessory the helmet.

12. The helmet of claim 11, further comprising:

an anchor member that is connected to the receptacle housing and which extends into the inner liner member.

13. The helmet of claim 12, wherein the anchor member includes:

at least one leg member portion extending in one direction away from the receptacle housing and into the inner liner member, and a least one cross member portion which traverses through the inner liner member in a different direction than the one direction to prevent the anchor member from becoming detached from the inner liner member.

14. The helmet of claim 11, wherein the inner liner member is insert molded to the outer shell.

15. The helmet of claim 11, wherein the engagement means includes a pair of opposing prongs for engaging the helmet accessory mounting member.

16. The helmet of claim 11, wherein:

the mounting member is a threaded screw; and the engagement means includes a threaded recess for engaging the threaded mounting member.

17. The helmet of claim 11, wherein the mounting hole has a non-circular shape.

18. The helmet of claim 11, wherein the receptacle has a non-circular shape.

19. The helmet of claim 11, wherein the securing means includes engagement arms extending from one of the grommet and the receptacle housing for engaging a tab formed on the other of the grommet and the receptacle housing.

20. The helmet of claim 11, further comprising:

a shaped spacer disposed between the upper shell surface and the grommet and having a spacer hole aligned over the mounting hole, wherein the grommet is aligned to the spacer hole for properly locating and orienting the grommet on the upper shell surface.

21. A method of making a composite helmet to which a helmet accessory having at least one mounting member can be removably attached, the method comprising the steps of:

forming an inner liner member for substantially covering a wearer's head;

forming an outer shell member that includes an upper shell surface, a lower shell surface for substantially covering an upper liner surface of the inner liner member, and at least one mounting hole formed therethrough;

disposing a grommet along the upper shell surface and aligned over the mounting hole;

disposing a receptacle housing having a receptacle along the lower shell surface so that the receptacle is aligned to and faces the mounting hole, wherein the receptacle includes means for removably engaging a mounting member of a helmet accessory when the mounting member is inserted through the mounting hole;

securing the grommet to the receptacle housing with the shell member therebetween; and affixing the upper liner surface of the inner liner member to the lower shell surface.

22. The method of claim 21, wherein the inner liner forming step and the affixing step are performed by insert molding the inner liner member to the outer shell member.

23. The method of claim 22, wherein an anchor member is connected to the receptacle housing so that the inner liner member is integrally molded around the anchor member.

24. The method of claim 23, wherein the anchor member includes:

at least one leg member portion extending in a direction away from the receptacle housing and into the inner liner member, and a least one cross member portion which traverses through the inner liner member in a different direction than the one direction to prevent the anchor member from becoming detached from the inner liner member.

* * * * *